United States Patent [19]

Poehlmann

[11] 4,272,887

[45] Jun. 16, 1981

[54] PIVOTING BLADE KNIFE

[76] Inventor: Paul W. Poehlmann, P.O. Box 487, Stinson Beach, Calif. 94970

[21] Appl. No.: 40,066

[22] Filed: May 17, 1979

[51] Int. Cl.[3] ..... B26B 1/00

[52] U.S. Cl. ..... 30/161

[58] Field of Search ..... 30/160, 161

[56] References Cited

U.S. PATENT DOCUMENTS

| | | | |
|---|---|---|---|
| 3,942,249 | 3/1976 | Poehlmann | 30/161 |
| 4,145,808 | 3/1979 | Walsh | 30/161 X |
| 4,148,140 | 4/1979 | Lile | 30/161 |
| 4,170,061 | 10/1979 | Henry | 30/160 |

*Primary Examiner*—Jimmy C. Peters

*Attorney, Agent, or Firm*—Lothrop & West

[57] ABSTRACT

A knife for personal use includes a frame of two substantially identical frame plates held in registering parallelism by a spacer pinned in position. The frame plates have generally circular openings therethrough in alignment on a transverse axis. The openings each depart from circularity by including one and preferably two extended pockets. A blade at one end having an identical opening and a pocket or pockets has such end disposed between the plates and pivotally held therein by a flanged, threaded sleeve passing through the openings and secured by a ring nut. The sleeve at the flange end has a cross slot to define sleeve pockets registering with the plate and blade pockets. A headed bolt extends reciprocably and yieldably through the sleeve and at one end has a cross bar adapted in one position to seat in the blade pockets, in at least one of the plate pockets and in the sleeve pockets. A spring urges the bolt into that one position, but the bolt can be displaced to shift the bolt cross bar out of the blade pocket or pockets.

1 Claim, 8 Drawing Figures

FIG-1
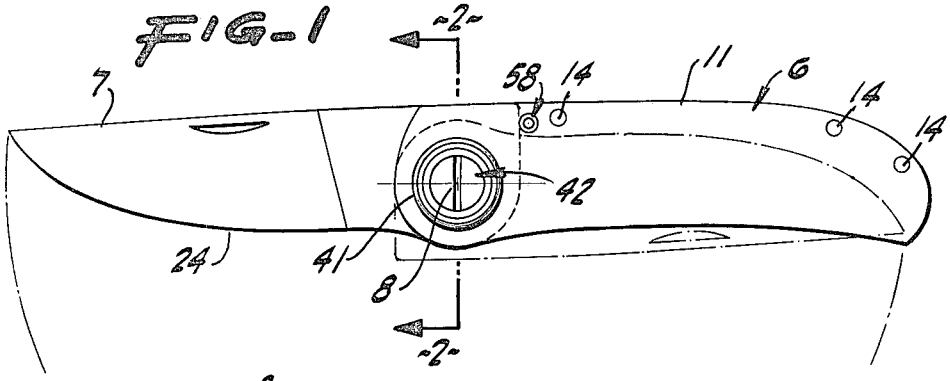
FIG-2
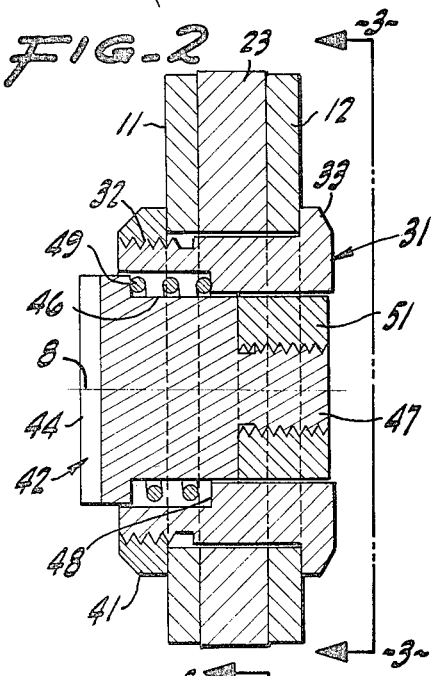
FIG-3
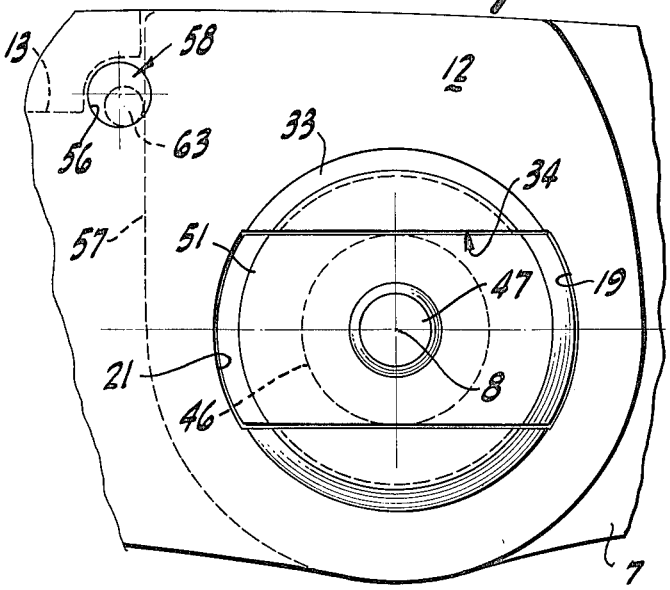
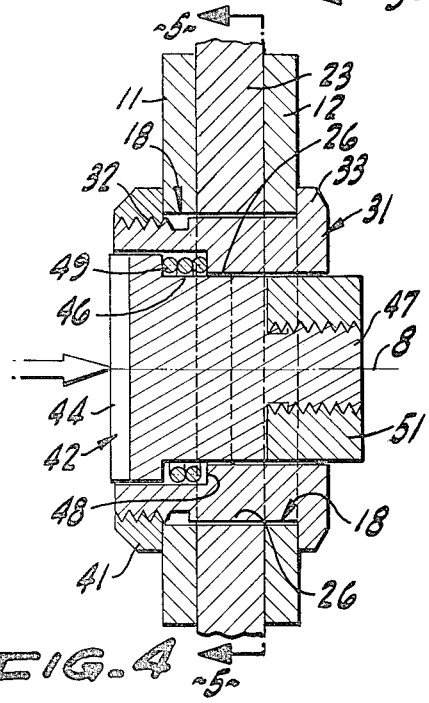
FIG-4
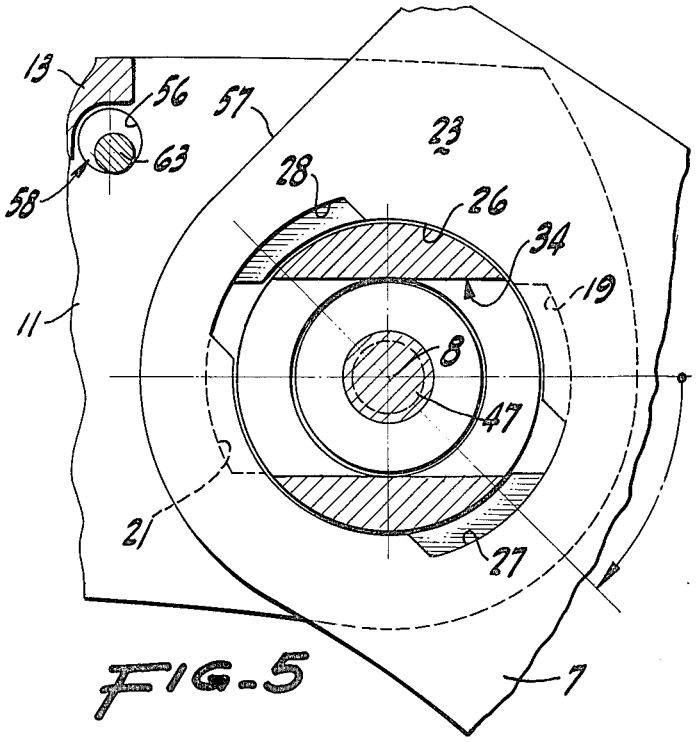
FIG-5

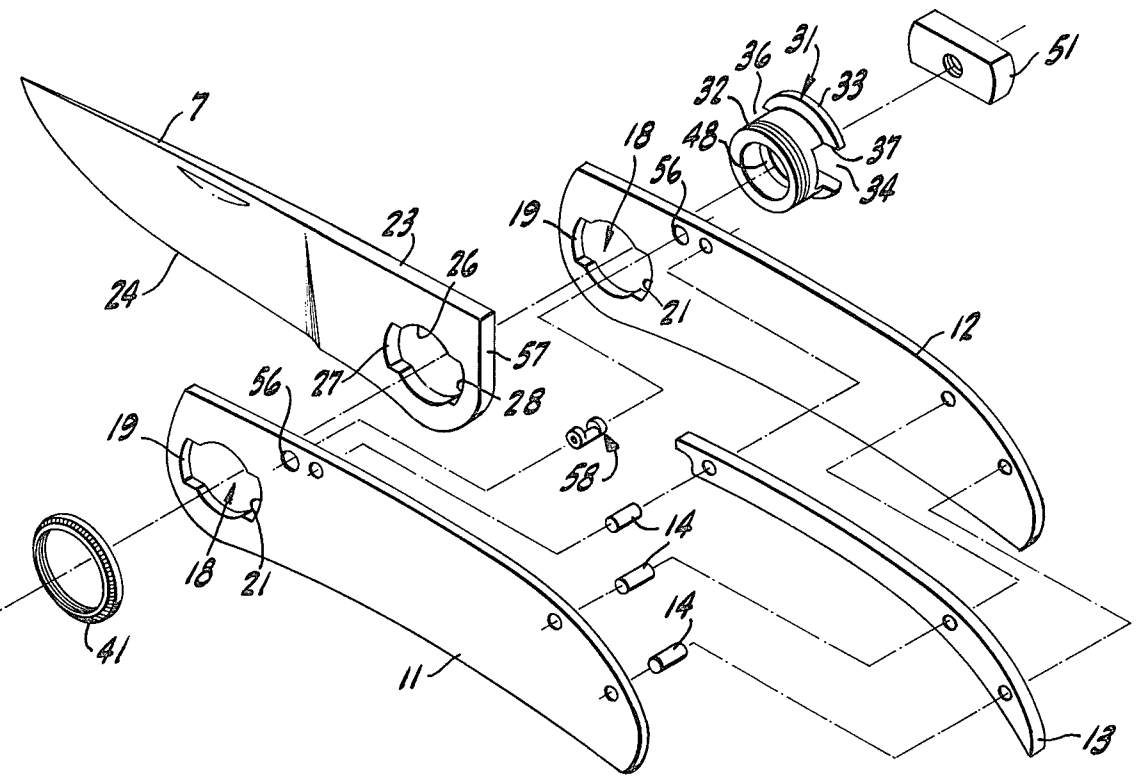
FIG-6
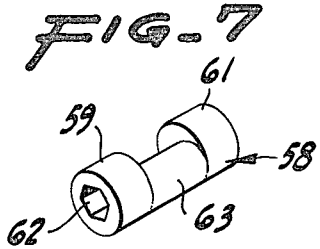
FIG-7
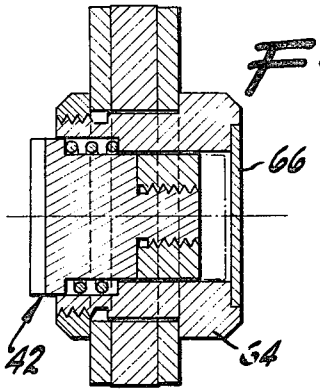
FIG-8
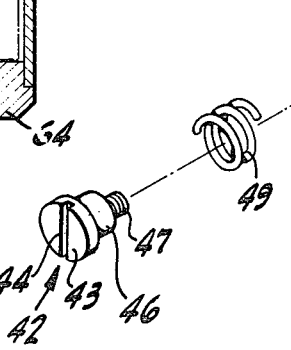

PIVOTING BLADE KNIFE

BRIEF SUMMARY OF THE INVENTION

A pivoting blade personal or pocket knife has a blade that is pivotal with respect to the knife frame plates. The blade may be locked to a frame plate in extended or folded position by a cross bar on a through bolt that serves as a blade pivot. The cross bar is movable out of blade-engaging position against spring urgency by finger pressure, so that momentarily the blade can be rotated with respect to the frame plates. If the blade is rotated one hundred eighty degress from its extended position, the cross bar can again engage with the non-circular openings in the blade and in at least one of the frame plates, so that the blade is again locked, but in closed position.

BRIEF DESCRIPTION OF THE SEVERAL VIEWS OF THE DRAWINGS

FIG. 1 is a side elevation of one side of the knife of my invention shown in open or extended position.

FIG. 2 is a view, with portions being broken away, in cross-section to an enlarged scale on the line 2—2 of FIG. 1.

FIG. 3 is a side elevation to the same scale as FIG. 2 and with portions broken away showing the other side of a portion of the structure.

FIG. 4 is a view comparable to FIG. 2 but showing the blade-retaining structure in blade-releasing position.

FIG. 5 is a view to the scale of FIG. 3 but taken in cross-section, the plane of which is indicated by the line 5—5 of FIG. 4, and with the blade in an intermediate rotated position.

FIG. 6 is an isometric perspective, with some parts being displaced, showing the knife parts in exploded position but generally in their assembled relative locations.

FIG. 7 is an isometric perspective showing to an enlarged scale a view of an adjusting eccentric for the blade.

FIG. 8 is a cross-section, similar to FIG. 2, and showing a modified form of construction.

DETAILED DESCRIPTION

As shown particularly in one embodiment and in FIG. 1, the knife for personal use pursuant to this invention includes a handle portion 6 and a blade portion 7 that are pivotal with respect to each other about a transverse axis 8. The knife can be rigidly extended for use and can be rigidly folded not only for protection of the sharp edge but also for reducing the compass or extent of the knife.

The handle or body 6 is comprised of a pair of side plates 11 and 12. These are substantially identical, so that the description of one applies also to the other. For example, the plate 11 has an appropriate envelope shape for holding in the hand and is generally elongated on one side away from the axis 8. The plate 11 is customarily joined to the plate 12 and in parallelism therewith by an intervening spacer 13 of relatively shallow dimensions and held in place by a number of through pins or rivets, collectively designated 14.

Particularly pursuant to the present invention, each of the plates 11 and 12 near one end and symmetrical with the axis 8 is contoured to define a plate opening 18 therethrough, this opening being largely circular-cylindrical but having at least one pocket 19 formed therein of a larger radius or extent than the remainder of the opening. Preferably, the opening pocket 19 is supplemented by a diametrically opposite second pocket 21 across the axis 8.

Designed to be interfitted with the plates 11 and 12 is the blade 7 that at one end has a relatively thick portion 23 easily received between the plates 11 and 12 and that at a margin going to the other end has a sharp edge 24 of any appropriate contour. The end portion 23 of the blade has a largely circular opening 26 therethrough symmetrical about the axis 8 and of the same general configuration as the circular portions 18 of the plate openings. Furthermore, the opening has pockets 27 and 28 therein corresponding generally in configuration and position with the pockets 19 and 21 of the plates.

When the blade is inserted between the plates, and preferably with the openings 18 and 26 in alignment, there is passed through the various openings a sleeve 31. This is a generally tubular body having threads 32 on one end and having a radially outstanding flange 33 at the other end. The outside of the sleeve 31 is of a size to fit with good rotational quality within the openings 18 and 26. The sleeve, in addition, has a cross slot 34 therein extending in a diametrical direction so as to define pockets 36 and 37 in the sleeve body and in the sleeve flange, those pockets generally conforming to or registering with the pockets 19 and 21, as well as the pockets 27 and 28.

The sleeve is so inserted through the plates and blade and then is held in position with the flange 33 against the plate 12 by a ring nut 41 engaging the threads 32 and abutting the plate 11. With the device as so far described, the blade is freely rotatable relative to the plates about the axis 8.

In order to limit the relative blade and plate rotation, there is disposed through the sleeve 31 a bolt 42 inclusive of a relatively large head 43 having a cross screwdriver slot 44 therein and having a shoulder body 46 diminishing to a threaded stem 47. The bolt is inserted into the sleeve 31 with the bolt body 46 movable toward and away from an internal flange 48 on the inside of the sleeve 31. A spring 49 is interposed between the shoulder body 46 of the bolt and the flange 48 of the sleeve. The threaded stem 47 of the bolt receives a cross bar 51 of a configuration relatively freely movable in the pockets 19 and 21, as well as 27 and 28 and also 36 and 37. Preferably, the threads 47 engage the cross bar 51 so tightly as to be immovable under any ordinary usage.

With the parts as so far described, the spring 49, acting against the flange 48 and the head 43, urges the bolt 42 toward the left in FIGS. 2 and 6 and holds the cross bar 51 not only in the pockets 36 and 37, but also in the pockets 19 and 21, at least, of the plate 12, and also in the pockets 27 and 28 of the blade 7. With the parts in that relationship, the cross bar 51 acts as a key, precludes relative rotation between the blade 7 and the plate 12, and holds the blade and the handle in fixed, extended relationship. However, if finger pressure is exerted on the head of the bolt 42, the bolt is moved toward the right in FIGS. 2, 4 and 6 against the urgency of the spring 49, which is virtually collapsed. The displaced bolt is effective to move the cross bar 51 at least far enough to the right so that the cross bar no longer resides in the pockets 27 and 28 of the blade, although the cross bar may still reside in the pockets 19 and 21, as well as 36 and 37.

With this new relationship of the parts, there is nothing to preclude relative rotation between the blade 7 and the plates 11 and 12, so that the user can readily rotate the blade through any desired angle, preferably about one hundred eighty degrees. In the one hundred eighty degree position, the various pockets again are in substantial registry. If then the bolt 42 is released, the spring 49 is effective to drive the bolt and the cross bar 51 from one extreme position into another extreme position with the cross bar again lodged in the pockets 27 and 28 or, depending on dimensions, perhaps even as far as partially into the pockets 19 and 21. In this free bolt position, the blade 7 is again locked relative to the plates 11 and 12 against relative rotation, so that the knife is held in closed position.

A reverse rotation to unfold the knife is readily accomplished by again depressing the bolt and manually rotating the blade. When the bolt is then released, the parts are again locked in extended or open position.

It sometimes occurs in manufacture that there is an accumulation of clearances so that even when the knife is in open position the blade may not be thoroughly stable with respect to the plates. For that reason, each plate 11 and 12 also has a pin aperture 56 therein adjacent a transverse, non-concentric end 57 on the blade some distance from the axis 8. Seated in the apertures 56 is a cross pin 58 having journals 59 and 61 thereon as well as a wrench depression 62 leaving an eccentric, central cylindrical portion 63.

When the knife is first assembled, the pin 58 is inserted in the apertures 56 and is rotated until the eccentric portion 63 just touches the face or end 57 of the blade. That ensures that there is no play or lost motion between the blade in open position and the rest of the structure. In the adjusted position of the eccentric pin, it is secured in place by an appropriate adhesive. After its initial assembly, the knife is kept in condition for future tight relationship of the parts.

For additional enclosure of the knife parts, the construction may alternatively include a sleeve 64 (FIG. 8), like the sleeve 31 but having an axially longer flange 64. This flange accommodates a closure plate 66 as a partial protector.

I claim:

1. A pivoting blade knife comprising a plate having a plate opening therethrough, said plate opening having one part circular at one distance from a transverse axis and having a first pocket at a different distance from said axis; a blade having a transverse surface and having a blade opening therethrough, said blade opening having one part circular at said one distance from said axis and having a second pocket at a different distance from said axis; a sleeve concentric with said axis and fitting said circular parts of said plate opening and said blade opening; means for holding said sleeve against movement along said axis relative to said plate; means defining a third pocket in said sleeve; a bolt movable in said sleeve along said axis between a first position and a second position; means on said bolt slidably fitting said plate pocket and said blade pocket in said first position and fitting only one of said plate and blade pockets in said second position; means yieldably urging said bolt into said first position; a cross pin rotatable in said plate; and an eccentric portion on said pin adapted to abut said transverse surface.

* * * * *